US007770638B2

(12) United States Patent
Kabishcher et al.

(10) Patent No.: US 7,770,638 B2
(45) Date of Patent: Aug. 10, 2010

(54) METHOD FOR COMPLETION, MAINTENANCE AND STIMULATION OF OIL AND GAS WELLS

(75) Inventors: Gennadi Kabishcher, Beer Sheva (IL); Yuri Ass, Beer Sheva (IL)

(73) Assignee: Flow Industries Ltd., Mishor Yamin (IL)

( * ) Notice: Subject to any disclaimer, the term of this patent is extended or adjusted under 35 U.S.C. 154(b) by 0 days.

(21) Appl. No.: 12/229,005

(22) Filed: Aug. 19, 2008

(65) Prior Publication Data

US 2010/0044032 A1 Feb. 25, 2010

(51) Int. Cl.
*E21B 28/00* (2006.01)
*E21B 43/00* (2006.01)

(52) U.S. Cl. ..... 166/249; 166/63; 166/177.6

(58) Field of Classification Search ..... 166/249, 166/177.1, 177.6, 299, 63
See application file for complete search history.

(56) References Cited

U.S. PATENT DOCUMENTS

| | | | | |
|---|---|---|---|---|
| 3,113,621 | A * | 12/1963 | Krueger et al. | 166/249 |
| 3,830,294 | A | 8/1974 | Swanson | |
| 4,291,395 | A | 9/1981 | Holmes | |
| 4,323,991 | A | 4/1982 | Holmes | |
| 4,665,980 | A | 5/1987 | Bodine | |
| 5,009,272 | A | 4/1991 | Walter | |
| 5,297,631 | A | 3/1994 | Gipson | |
| 5,361,830 | A | 11/1994 | Wicks et al. | |
| 5,439,290 | A | 8/1995 | Wicks et al. | |
| 5,579,845 | A * | 12/1996 | Jansen et al. | 166/299 |
| 6,250,388 | B1 | 6/2001 | Carmi et al. | |
| 6,390,191 | B1 * | 5/2002 | Melson et al. | 166/177.1 |
| 2003/0008779 | A1 | 1/2003 | Chen et al. | |
| 2004/0060698 | A1 | 4/2004 | Ravensbergen et al. | |
| 2007/0187112 | A1 * | 8/2007 | Eddison et al. | 166/380 |

OTHER PUBLICATIONS

SPE/Petroleum Society of CIM/CHOA 79033 "Pressure Pulse Workovers in Heavy Oil", Maurice Dusseault et al., copyright 2002, pp. 1-10.*

* cited by examiner

*Primary Examiner*—Giovanna C Wright
(74) *Attorney, Agent, or Firm*—Robert G. Lev

(57) ABSTRACT

A method for inducing motion in solid particulates in a solid/liquid mixture located in proximity to the periphery of a wellbore or in the formation zone adjacent to a wellbore in an oil or gas formation. The method includes introducing a gas impulse device into the wellbore. It then requires firing the gas impulse device so as to generate impulses of high pressure compressed gas, thereby to produce pressure waves within the wellbore and its surrounding formation. This causes motion of the solid particulates which permits settling and/or redistribution of the solid particulates. In some cases it even causes particulate flow, as in cold heavy oil production with sand (CHOPS). The method also frees blockages caused by the solid particulates and stimulates productivity. The method may inter alia be used in gravel pack construction and maintenance, well cementing operations and in CHOPS stimulation.

1 Claim, 2 Drawing Sheets

METHOD FOR COMPLETION, MAINTENANCE AND STIMULATION OF OIL AND GAS WELLS

FIELD OF INVENTION

The present invention relates to a method for cementing, completing, maintaining and stimulating oil and gas wells using vibration inducing pressure waves.

BACKGROUND OF THE INVENTION

Gravel packs are well known techniques for preventing sand from entering a wellbore. A gravel pack is generally formed by placing gravel or sand of a predetermined specific size into the annulus between a casing and a well screen in the wellbore. For effective operation, it is important that the solids in the pack be relatively uniformly distributed with a minimum of voids.

Prior art discloses use of a pulsing fluid flow to stabilize a gravel pack by increasing the density of the gravel pack. However, merely pulsing the flow imparts only a limited amount of energy into the gravel pack.

Another prior art method for stabilizing a gravel pack includes vibrating a drill string and gravel pack apparatus by imparting a sonic frequency vibration at the wellhead. This method is useful if the drill pipe does not have significant contact with the wellbore or casing above the gravel pack. However, in practice, this is rarely the case. Vibrations imparted at the wellhead therefore can be significantly dampened, and vibrations of only a small magnitude may actually arrive at the gravel pack.

Yet another prior art method for producing vibrations for stabilizing a gravel pack uses balls constrained to move within a wash pipe. The balls strike the wash pipe walls which transfer the vibrations to the fluid in the gravel pack annulus. These vibrations in turn are transferred to the gravel pack screen causing the gravel pack solids to vibrate around the screen providing better gravel pack density. This method suffers from low efficiency resulting from the rapid attenuation of vibrations across the wellbore.

Cementing is a routine procedure in oil and gas well drilling operations. During this procedure, a cement-based slurry is pumped into the annulus between the wellbore wall and casing to provide isolation of the reservoir formation from the wellbore as well as to support the casing. This cementing procedure, however, often fails to achieve adequate isolation and there is undesirable communication between the wellbore and the oil-bearing formation.

Inadequate isolation has been attributed to several factors. These include: (1) fluid leaking from the cement into the formation causing a volume reduction when a pressure differential exists across the curing cement; (2) the volume of the slurry contracting up to 6%, during the cement hydration process, allowing micro-annuli to form between the casing and oil-bearing formation; (3) unset cement is very permeable until it develops sufficient strength to prevent fluid influx; and (4) a lowering of the hydrostatic pressure in the annulus that can lead to fluid influx as a result of the development of gel strength in cement slurries. This combination of volume losses due to fluid loss and hydration, loss of hydrostatic pressure because of gel strength and a weak, permeable cement matrix provides an environment for reservoir formation influx to occur.

To overcome these problems, a method of introducing a cement slurry with pulsation was developed. Cement pulsation is the application of low intensity pressure pulses to the annulus after a primary cement job thereby delaying gel strength development in the cement slurry. This method, however, cannot prevent voids from arising during deposition of the cement slurry and water outflow from the slurry into the formation.

Vibrations have also been used to enhance the packing of the solid particulates in cement slurries during the cementing operations. In one instance, vibration has been achieved when a bluff object impacts the walls of the cement slurry flow conduit. The energy of impact depends on the flow velocity and that may be too low to provide the necessary improved packing effect.

In view of the problems discussed above, a more effective method for generating vibrations for use in gravel pack and cementing operations in oil and gas well construction is required. The method should generate strong vibrations with little attenuation and be introducible with as little damping as possible. The method should supply the necessary amount of energy to all intervals of the gravel pack or casing for the required amount of time. The method should also supply the necessary amount of energy for solids stimulation and be effectively independent of flow velocity or other factors.

SUMMARY OF THE INVENTION

An object of the present invention is to provide a method for settling and/or redistributing solid particulates in heterogeneous solid/liquid mixtures used in oil and gas well completion. These mixtures include, but are not limited to, cement slurries used in cementing operations and gravel-fluid mixtures used in forming gravel packs. The method uses vibrations produced by a gas impulse device.

Another object is to provide a method for loosening clogged material in well screens, well perforations and oil formation pores using vibrations, thereby increasing oil well production.

Another object of the present invention is to provide a method for stimulation of solid/liquid mixture flow into oil and gas wells by means of a gas impulse device.

Another object of the present invention is to provide a method for producing high energy vibrations with minimum attenuation and damping for use in particle settling and/or distribution and/or other particulate motion in oil and gas wells.

In a first aspect of the present invention, there is provided a method for inducing motion in solid particulates in a solid/liquid mixture located in proximity to the periphery of a wellbore or in the formation zone adjacent to a wellbore in an oil or gas formation. The method includes the following steps: introducing a gas impulse device into the wellbore; and firing the gas impulse device so as to generate impulses of high pressure compressed gas, thereby to produce pressure waves within the wellbore and the formation surrounding it, and thereby to vibrate, so as to cause motion of the solid particulates.

In an embodiment of the method, the step of introducing includes introducing the device adjacent to the lowest point of the mixture and the step of firing further includes a step of moving the gas impulse device along the entire length of the mixture while the impulse device is periodically fired.

In another embodiment of the method the step of introducing includes introducing the device adjacent to the highest point of the mixture and the step of firing further includes a step of moving the gas impulse device along the entire length of the mixture while the impulse device is periodically fired.

In a further embodiment of the method, the step of introducing includes introducing the device adjacent to the mixture and the step of firing further includes periodically firing the device as the device is kept stationary positioned adjacent to the mixture.

In still another embodiment of the method, the step of introducing includes introducing the device to a depth above the mixture and the step of firing further includes periodically firing the device as the device is kept stationary positioned at that depth.

In a further embodiment of the method, the motion of the solid particulates results in a settling of the particulates so that they pack more densely with a minimum of voids.

In yet another embodiment of the method, the motion of the solid particulates results in a flow of the mixture.

The method of the present invention may be used where the solid/liquid mixture is a mixture selected from a group of mixtures, the group consisting of: a cement slurry for use in a cementing operation in the wellbore; a gravel mixture for use in a gravel pack construction in the wellbore; and an oil laden sand deposit from which oil is to be extracted.

In another embodiment of the method, the step of firing the gas impulse device occurs while the mixture is being deposited and positioned in, or adjacent to, the wellbore.

In still another embodiment of the method, the step of firing the gas impulse device occurs after the mixture has been deposited and positioned in, or adjacent to, the wellbore.

In a second aspect of the present invention, there is provided a method for settling solid particulates in a solid/liquid heterogeneous mixture deposited in proximity to a casing of a wellbore. The method includes the following steps: inserting a gas impulse device into the wellbore immediately after completing deposition of the mixture; firing the gas impulse device inside the casing generating vibrations in the casing thereby to cause settling of the solid particulates in the deposited mixture; and moving the device along the casing while firing the gas impulse device providing vibration to the casing and accordingly, to the deposited mixture. In this second aspect of the invention, the solid/liquid mixture is a mixture selected from a group of mixtures, the group consisting of: a cement slurry for use in a cementing operation in the wellbore; and a gravel mixture for use in a gravel pack construction in the wellbore. In one embodiment, in the steps of firing and moving, the vibrations are generated in a screen forming a part of the casing. In another embodiment of this method, the step of inserting is effected during the deposition of the mixture, while in another embodiment of this method, the step of inserting is effected after deposition of the mixture.

In a third aspect of the present invention, there is provided a method for stimulating production in cold heavy oil production with sand (CHOPS) operations in an oil laden sand formation. The method includes the following steps: introducing a gas impulse device into a wellbore up to a depth whereat oil laden sand is present in the formation adjacent to the wellbore; and firing the gas impulse device periodically so that the device generates impulses of high pressure compressed gas and the pressure waves therefrom generate vibrations which dislodge sand trapped in perforations of the wellbore and blockages in the formation preventing sand flow, improving movement of the oil laden sand into the wellbore. In an embodiment of this third aspect of the invention, the method further includes a step of moving the gas impulse device along the entire length of the oil laden sand containing formation while periodically firing the device.

In a fourth aspect of the present invention, there is provided a method for producing movement of solid particulates in a solid/liquid mixture deposited in proximity to the periphery of a wellbore or in a formation zone adjacent to the wellbore in an oil or gas formation. The method includes the following steps: introducing a gas impulse device into the wellbore to a depth of the deposited mixture; and firing the gas impulse device periodically so that the device generates impulses of high pressure compressed gas, the pressure waves therefrom causing motion of the solid particulates which produces a more uniform distribution and more dense packing of the particulates in the mixture or stimulate flow of the mixture. The mixture used with the fourth aspect of the invention is a mixture selected from a group of mixtures, the group consisting of: a cement slurry used in a cementing operation in the wellbore; and a gravel mixture used in forming a gravel pack in the wellbore.

BRIEF DESCRIPTION OF THE FIGURES

The present invention will be more fully understood and its features and advantages will become apparent to those skilled in the art by reference to the ensuing description, taken in conjunction with the accompanying drawings, in which.

Similar elements in the Figures are numbered with similar reference numerals.

DETAILED DESCRIPTION OF THE PREFERRED EMBODIMENTS OF THE INVENTION

Figure 1:
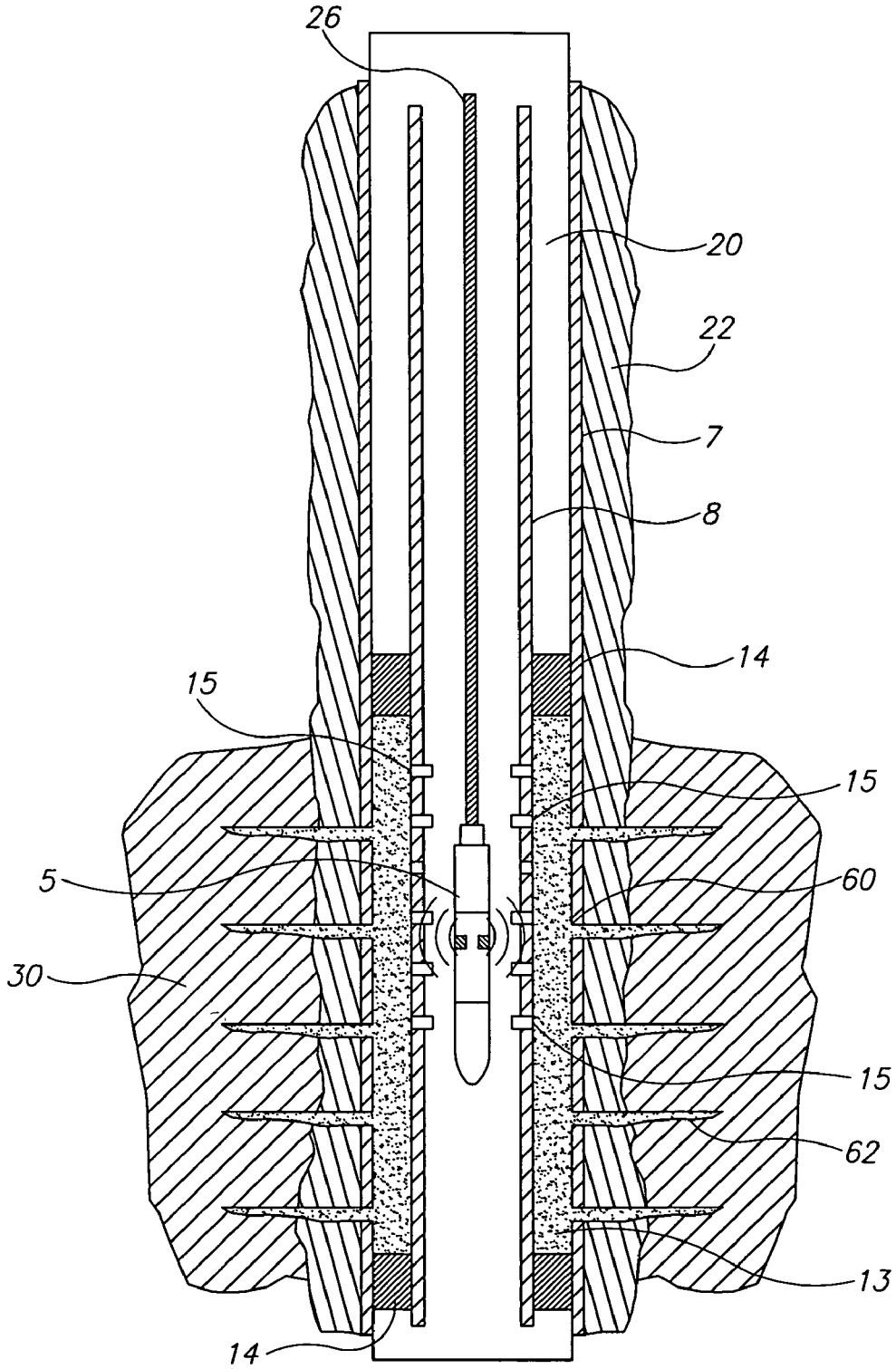
FIG. 1 illustrates the positioning and use of a gas impulse device in a wellbore according to an embodiment of the present invention for stabilizing gravel packs.

The present invention provides a method which uses pressure waves generated by a gas impulse device to produce vibrations for improving the settling and distribution of solid particulates in solid/liquid heterogeneous mixtures employed in oil and gas well drilling and completion operations. The vibrations generated by the device can also be used to dislodge solid blockages that reduce production in an oil or gas well. An example of the latter is sand blockages which form in the pores of the heavy oil-bearing formation and/or perforations of a wellbore during cold heavy oil production with sand (CHOPS) operations.

The method of the present invention typically includes: (a) positioning a gas impulse device in a wellbore, typically in a region of the wellbore adjacent to a zone requiring redistribution or settling of the solids in a heterogeneous solid/liquid mixture or of solids interfering with hydrocarbon production; and (b) cyclically firing the gas impulse device which emits an impulse, that is a "blast" of gas, having a predetermined pressure at predetermined intervals for predetermined durations. The pressure waves produced by the device in turn generate vibrations in the region of the wellbore containing a screen and a gravel pack, in the annulus between a casing and borehole containing a cementing slurry, and/or at the wellbore-formation interface, and/or the wellbore's perforations and/or pores in the surrounding formation during CHOPS operations. These vibrations cause more uniform settling and distribution of the solids in the heterogeneous mixture, turn large solid aggregates into smaller ones and/or dislodge solid blockages interfering with hydrocarbon production. The firing of the gas impulse device generates particulate motion and sometimes, as in CHOPS, even particulate flow.

In one embodiment of the present invention gravel packing operations in oil or gas well completion can be made more effective using impulses produced by a gas impulse device and vibrations resulting from such impulses.

Placing a gravel envelope around a well screen is a common method of controlling sand influx from the formation into a well. In gravel pack operations, a steel screen is placed in the wellbore and the surrounding annulus is packed with gravel or sand of a predetermined size designed to prevent the migration of sand from the formation into the wellbore. Gravel packing stabilizes the formation while only minimally impairing well productivity.

To be effective, a gravel pack should be comprised of densely packed gravel or sand, lacking voids or cavities. If portions of the annulus around the screen are not packed completely with gravel or sand and voids exist, formation fluids containing formation sand quickly erode the screen, leading to failure of the gravel pack. Another problem with a gravel pack is its plugging over time with fine soluble and insoluble particles. These factors reduce permeability of the pack and accordingly the overall production capacity of the well is reduced.

The present invention teaches a method of gravel pack stabilization by means of activating a gas impulse device generating pressure waves which provide vibrations throughout the gravel pack. The vibrations cause uniform settling and packing of the solids in the gravel pack and/or removal of any clogging material in the support screen.

In what is discussed in the specification and claims herein with respect to the gravel pack embodiment, the use of the term "gravel" alone also includes the possibility of using sand and the use of the term "sand" alone also includes the possibility of using gravel, unless specifically indicated otherwise.

In what is discussed in the specification and claims herein, directions are relative to the well head. The "bottom" of the wellbore is that end of the wellbore distal from the wellhead while "top" of the wellbore is the surface termination of the wellbore, i.e. the wellhead. Similarly, moving in the upward direction is motion toward the wellhead while moving downward is motion away from the wellhead and toward the bottom of the wellbore.

Reference is now made to FIG. 1 where the use of a gas impulse device to allow for more uniform and denser packing of the gravel pack is illustrated.

Gas impulse device 5 is lowered into a wellbore 20. Packer 14, also sometimes referred to herein as a packer element, is positioned substantially concentrically about production pipe 8 within wellbore 20. Packer 14 hydraulically seals and isolates the zone of wellbore 20 near that portion of the oil bearing rock formation 30 from which oil is to be extracted. Packer 14 may be constructed from one or more materials known to persons skilled in the art.

High-pressure gas is supplied to gas impulse device 5 from a surface gas source (not shown). A pipeline 26 provides compressed gas supply from the source (not shown) to gas impulse device 5. Pipeline 26 has been truncated in the Figure because of space considerations. Typically, but without intending to limit the invention, pipeline 26 may be in the form of a high-pressure hose, metal piping or coil tubing.

After positioning gas impulse device 5 in wellbore 20, gas impulse device 5 is activated at predetermined intervals so as to deliver gas pressure waves. When gas impulse device 5 is fired pressure waves are generated having a predetermined pressure and duration.

According to one embodiment of the present invention, gas impulse device 5 is positioned at a preselected region of wellbore 20. As noted above, it may inter alia be positioned against i) any region of production pipe 8, or ii) against a region of wellbore 20 containing screen 15 and gravel pack 13.

It should be noted that in some embodiments gas impulse device 5 may be placed at the level of the pay zone of the well; in other embodiments, device 5 may be positioned at a level above the pay zone of the well.

In some instances, the device may be held stationary next to the casing perforations while in other embodiments the device may be moved along the length of the casing perforations.

A typical gas impulse device which may be used in the present invention is discussed in U.S. Pat. No. 6,250,388 to Carmi et al, herein incorporated by reference. This is an exemplary device only and it is not intended to limit the invention. Such a device is commercially available from Prowell Technologies Ltd., Mishor Rotem, Israel. Other gas impulse devices known to those skilled in the art may also be used.

The impulse produced by the device causes an initial shock wave and subsequent oscillating gas bubbles. With gravel pack stabilization it should be noted that the well is often filled with fluid, usually a formation fluid, but also sometimes a drilling fluid. Formation fluid fills the well when well casing perforations are open. The initial shock wave produced upon firing the device and subsequent secondary waves created by resulting oscillating gas bubbles are transmitted through the fluid to the gravel or sand particles of the gravel pack or to the casing of the wellbore. What is generally vibrating in gravel pack applications is the screen and it transfers vibrations to the gravel particles. The frequency of the waves used is typically in the range of 0-500 Hz. These powerful low-frequency waves create strong vibrations in the region of the wellbore adjacent to the gas impulse device.

In some applications, the gas impulse device may be kept in position in one place in the wellbore but the vibrations are transferred over the entire length of the wellbore or over a desired interval thereof. Since the vibrations are generally transferred via the metal screen, the gas impulse device may be positioned and fired above the depth of the gravel pack itself.

In a cementing operation (see the embodiment described below in conjunction with FIG. 2), the device when fired creates vibrations in the wellbore casing. The device may in some cases be held at a constant depth in the wellbore. Alternatively, the device may be moved along a predetermined interval of the wellbore thereby concentrating the impulse energy.

In an embodiment of the present invention, but without intending to limit the invention, the gas impulse device may have a diameter in the range of about 1.5" to about 3.7". The gas pressure supplied may range from a pressure of about 50 bars to about 350 bars, more preferably, from about 50 bars to about 250 bars, and even more preferably, from about 50 bars to about 200 bars. The gas receiving chamber of the impulse device is, typically, but without intending to limit the invention, at least 0.3 liters for a 1.5" device and 1.5 liters for a 3.7" device. Impulse durations typically may range from about 50 milliseconds to about 100 milliseconds. In some embodiments, the impulse durations may exceed 100 milliseconds.

In FIG. 1, gas impulse device 5 is positioned adjacent to screen 15, the latter lying adjacent to or hanging from production pipe 8. Gravel pack 13 is positioned between screen 15 and production pipe 8 and well casing 7. Perforation tunnels 62 extend into oil bearing formation 30 from perforations 60 and connect wellbore 20 with formation 30. Wellbore 20 also includes packing elements 14 which function as discussed previously. Between well casing 7 and oil bearing formation 30 is a cement annulus 22.

As noted previously, the gas impulse device is periodically fired producing pressure waves causing powerful vibrations in the gravel pack that stabilize, i.e. settle and/or redistribute, the gravel pack sand or gravel so that it is more densely packed, minimize voids in the pack, and remove plugging in the pack.

In another embodiment of the present invention, the method also provides for increasing the structural integrity of the cement layers when cementing operations are used in the drilling of oil and gas wells. It includes using vibrations produced by pressure waves generated when activating a gas impulse device to redistribute the solid particles in cement slurries.

The method according to the present invention for use of a gas impulse device to enhance the efficiency of a well cementing operation, typically, but without limiting the invention, includes the following steps:

injecting a cement slurry between the casing of a wellbore and an oil-bearing formation;

before the slurry strengthens, inserting the gas impulse device into the wellbore to a desired point in the wellbore;

activating, i.e. firing, the device inside the casing thereby producing a pressure wave that generates powerful vibrations in the wellbore casing which are in turn transferred to the cement slurry; and moving the device along the casing while firing the device at predetermined intervals thereby providing vibrations at substantially each point of the casing, thereby redistributing the solid particles at each portion of the cement slurry and also crushing aggregates therein so as to achieve a more uniform packing of the particles.

This method is generally employed when the well contains a fluid, any fluid such as, for example, a drilling fluid or a formation fluid.

The powerful vibrations over the entire length of the casing allow for the cement slurry to fill the entire annular space between the wellbore casing and the oil bearing formation. This prevents voids from forming within the cement body. The casing vibrations created adjacent to the cement slurry as a result of the pressure waves generated by the gas impulse device promote disaggregation of large cement aggregates into smaller ones. This provides for a denser more uniform cement packing. It also promotes better water penetration into the interstitial spaces between the solid particles of the cement paste increasing the cement's quality and its final strength. The pressure waves also involve more cement in the hydration process preventing water outflow from the slurry into the oil bearing formation.

Figure 2:
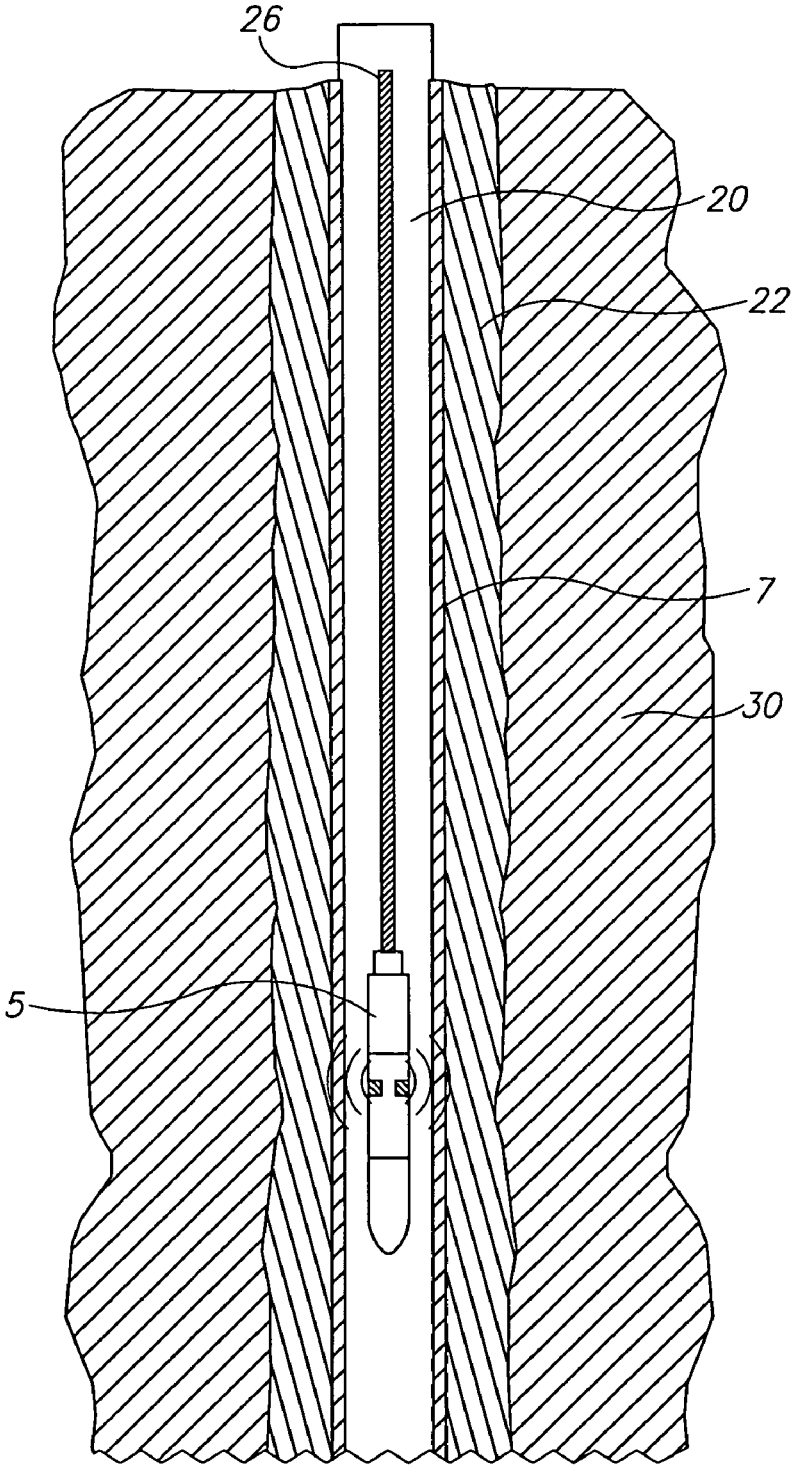
FIG. 2 illustrates the positioning and use of a gas impulse device in a wellbore according to an embodiment of the present invention for improving well cementing operations.

Reference is now made to FIG. 2 where the use of a gas impulse device to allow for more uniform and denser packing of a cement slurry in a cementing operation is illustrated.

Gas impulse device 5 is lowered into a wellbore 20 region having a casing 7 substantially defining its perimeter. High-pressure gas is supplied to gas impulse device 5 from a surface gas source (not shown) via a pipeline 26. Pipeline 26 has been truncated in the Figure because of space considerations. Typically, but without intending to limit the invention, pipeline 26 may be in the form of a high-pressure hose, metal piping or coil tubing.

An impulse generated by gas impulse device 5 creates a pressure impulse of a predetermined pressure and duration at predetermined intervals and is transmitted in wellbore 20 along casing 7 in the form of pressure waves.

An annular cement layer 22 is created by pumping a slurry of cement between formation 30 and casing 7. The cement slurry pumping apparatus depends on the cementing technique chosen and is not shown in FIG. 2. The cement slurry may typically be, but without intending to limit the invention, pumped prior to the insertion of the gas impulse device.

Gas impulse device 5 is positioned at a preselected region of wellbore 20, typically, but without limiting the invention, at the upper end of the zone containing the cement slurry. After positioning gas impulse device 5 in wellbore 20 at the desired depth, gas impulse device 5 is activated so as to deliver gas pressure impulses.

After device 5 is initially positioned at the upper end of the zone containing the cement slurry, gas impulse device 5 may be slowly moved down toward the well bottom while periodically firing the device along the entire length of casing 7. Firing occurs as the cement slurry is hardening. The pressure waves generated produce vibrations in the casing which in turn generate vibrations in the slurry. The pressure waves in the slurry cause the solid particles within the slurry to redistribute producing more uniform cement with a minimum number of voids upon hardening.

In some instances, the device may be held stationary next to the casing perforations while in other embodiments the device may be moved along the length of the casing perforations. In yet other embodiments, the device may be moved along the entire length of the casing. The ability to move the device along the entire length of the casing allows treatment of every interval of the cement column.

A typical gas impulse device which may be used in this embodiment of the present invention is discussed in U.S. Pat. No. 6,250,388 to Carmi et al, herein incorporated by reference. This is an exemplary device only and it is not intended to limit the invention. Such a device is commercially available from Prowell Technologies Ltd., Mishor Rotem, Israel. Other gas impulse devices known to those skilled in the art may also be used.

In an embodiment of the present invention, but without intending to limit the invention, the gas impulse device may have a diameter in the range of about 1.5" to about 3.7". The gas pressure supplied may range from a pressure of about 50 bars to about 350 bars, more preferably, from about 50 bars to about 250 bars, and even more preferably, from about 50 bars to about 200 bars.

As discussed previously, the gas impulse device is periodically fired producing pressure waves in the cement slurry settling and/or redistributing the particles therein so that they are more densely packed, voids are minimized and more particles are hydrated. The use of a gas impulse device to produce vibrations generates more energetic pressure waves, and hence more energetic vibrations, that show less attenuation and damping before arriving at the injected cement slurry than prior art methods. The intensity of the slurry vibration may be controlled by the firing pressure of the device and the number of firings of the device at a given casing interval.

In yet another embodiment of the present invention, the method may be used to stimulate oil production when cold heavy oil production with sand (CHOPS) is employed.

A special type of oil production is known in the art and referred to as CHOPS. During the CHOPS procedure, oil saturated sand particles are pumped from a well after there has been a massive continuous influx of such saturated sand into the well. If sand mobilization and/or flow is impeded during the CHOPS operation, production declines and may even cease. If sand flow velocities are low, sand may settle around the wellbore and re-compact. Additionally, the wellbore casing perforations may become plugged with sand particles, particularly larger particles. In these cases, clays, fine-grained minerals, and precipitated asphaltenes often plug the pore throats in the reservoir formation by the re-compacted sand around the well, virtually eliminating permeability.

During CHOPS, reservoir "failures" usually include inability to initiate sand influx, blockage of sand flow, loss of solution gas drive energy, and loss of gravitational drive energy. Blockage of perforations may occur because of cement or concretion chunks, flowing sand may re-compact around the well and prevent oil laden sand ingress, and so on. The gas impulse device of the present invention is operative for stimulation of the CHOPS wells by clearing such blockages.

The method according to the present invention of applying pressure waves generated by a gas impulse device to stimulate production in CHOPS, typically, but without intending to limit the invention, includes the following steps:

inserting the gas impulse device into a wellbore to the depth of the well casing perforations; and firing the device adjacent to the perforations thereby generating a pressure wave which produces vibrations removing blockages, allowing for the free entry of sand into the wellbore.

The pressure waves and vibrations created by the gas impulse device in the immediate vicinity of the sand surrounding the well stimulate sand influx into the well destroying any near-wellbore blockages. The apparatus may be fired simultaneously with the oil laden sand being pumped from the well or separately.

In some instances, the device may be held stationary next to the casing perforations while in other embodiments the device may be moved along the entire length of the casing perforations.

Prior art techniques have applied vibrations to create low amplitude pressure waves by means of inserting a piston inside the production pipe of an oil or gas well. Each time the piston ejects a liquid downhole it creates a single pulse. The piston generated wave carries low energy and has a frequency within only a narrow frequency range; such a wave is seldom efficient. The present invention generates pressure waves, and hence vibrations, having greater energy than prior art methods. The present invention exploits the combination of creating an initial powerful shock wave when firing a gas impulse device which is later followed by numerous secondary pressure waves resulting from oscillating gas bubbles. These waves carry a high amount of energy and have various frequencies ranging from 0 to 500 Hz which enable them to readily transfer vibrations to sand particles in the surrounding formation. The device firing cycle thereby creates a sand flow stimulation effect that is applicable to virtually any type of formation, sand particle size and distribution, type of blockage, etc.

The gravel pack stabilization and cementing techniques describe herein may also be used when constructing and maintaining water wells.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

It will be appreciated by persons skilled in the art that the present invention is not limited by the drawings and description hereinabove presented. Rather, the invention is defined solely by the claims that follow.

We claim:

1. A method for stimulating production in cold heavy oil production with sand operations in an oil laden sand formation, the method including the following steps:

introducing a gas impulse device into a wellbore up to a depth whereat oil laden sand is present in the formation adjacent to the wellbore;

firing the gas impulse device periodically so that the device generates impulses of high pressure compressed gas and the pressure waves therefrom generate vibrations which dislodge the oil laden sand trapped in perforations of the wellbore and blockages of oil laden sand flow in the formation, improving flow of the oil laden sand into the wellbore; and pumping the oil laden sand that has flowed into the wellbore, thereafter to effect the separation of the oil from the sand, said step of pumping occurring while said step of firing is executed.

* * * * *